United States Patent [19]

Ford

[11] 4,242,184

[45] Dec. 30, 1980

[54] MEMBRANE CELL CHLOR-ALKALI PROCESS HAVING IMPROVED OVERALL EFFICIENCY

[75] Inventor: James M. Ford, Cleveland, Tenn.

[73] Assignee: Olin Corporation, New Haven, Conn.

[21] Appl. No.: 24,749

[22] Filed: Mar. 28, 1979

[51] Int. Cl.[3] ..... C25B 1/16; C25B 13/08

[52] U.S. Cl. ..... 204/98; 204/128; 204/296

[58] Field of Search ..... 204/98, 128, 296

[56] References Cited

U.S. PATENT DOCUMENTS

| | | | |
|---|---|---|---|
| 4,057,474 | 11/1977 | Kurtz et al. | 204/98 |
| 4,076,603 | 2/1978 | Anderson | 204/98 |
| 4,076,604 | 2/1978 | Murayama et al. | 204/98 |
| 4,085,071 | 4/1978 | Resnick et al. | 204/98 X |
| 4,089,759 | 5/1978 | Krumpelt et al. | 204/98 |
| 4,147,600 | 4/1979 | Rutherford et al. | 204/128 X |

*Primary Examiner*—T. Tung
*Assistant Examiner*—D. R. Valentine
*Attorney, Agent, or Firm*—Donald F. Clements; James B. Haglind

[57] ABSTRACT

A process for the preparation of an alkali metal hydroxide and halogen from an alkali metal halide in a plurality of electrolytic cells, wherein each electrolytic cell is physically arranged in series with respect to the other electrolytic cells, the series having a first electrolytic cell and a last electrolytic cell, so that for a selected cell in the series, after the first electrolytic cell, catholyte alkali metal hydroxide from the catholyte chamber of a previous electrolytic cell is conveyed to the catholyte chamber of the selected electrolytic cell. The concentration of the alkali metal hydroxide is progressively increased toward a desired final concentration in the last cell through the series of electrolytic cells. Each electrolytic cell has an anolyte chamber containing an anode and a catholyte chamber containing a cathode, separated by a permselective membrane. The process of this invention is characterized by the improvement wherein the permselective membrane is employed to maximize cell power efficiency corresponding to the concentration of alkali metal hydroxide produced in the catholyte chamber of each cell.

14 Claims, 1 Drawing Figure

MEMBRANE CELL CHLOR-ALKALI PROCESS HAVING IMPROVED OVERALL EFFICIENCY

The present invention relates to an improved electrolytic process for preparing aqueous alkali metal hydroxides and halogens from aqueous solutions of alkali metal halides such as alkali metal brines.

Specifically, the present invention relates to an improved electrolytic process for preparing aqueous sodium hydroxide and chlorine from an aqueous sodium chloride brine solution.

Traditionally, aqueous solutions of sodium hydroxide and chlorine have been prepared by the electrolysis of sodium chloride brine. A perm-selective membrane may be employed between the cathode and anode to permit transport of sodium ions from the anode chamber to the cathode chamber but inhibit transfer of the alkali metal brine solution. Use of such membranes has provided a process for production of highly concentrated aqueous sodium hydroxide solutions which are relatively free of sodium chloride.

Key economic factors in the operation of membrane cells are the achievement of a long membrane life, the attainment of high current efficiency, the realization of a low voltage drop at high current densities and the production of a high concentration sodium hydroxide at the cell.

Achievement of a high current density reduces the original plant capital investment and the membrane replacement costs. Similarly, a high product concentration reduces the capital and operating costs of evaporation equipment required to bring the caustic product up to commercial concentration. Low voltage drop and high current efficiency reduce the energy requirements which are a substantial portion of the total manufacturing cost. The high cost of membrane materials and maintenance costs associated with membrane replacement require achievement of a long membrane life.

Production of caustic and chlorine by membrane cell electrolysis is a relatively energy and capital intensive process. Modifications to the electrolysis process resulting in energy and capital savings, are therefore of foremost importance.

The prior art has recognized that significant capital investment and energy savings can be achieved by arranging electrolytic cells in a series arrangement for the preparation of aqueous sodium hydroxide.

For example, U.S. Pat. No. 4,076,603, issued to John N. Andersen on Feb. 28, 1978, discloses a process wherein at least one cell of a membrane equipped electrolysis system a sodium hydroxide solution of relatively low concentration is produced by the electrolysis of brine containing sodium chloride. Sodium hydroxide of desired high concentration is then produced by electrolyzing brine containing sodium chloride in a second stage using the dilute sodium hydroxide produced in the first stage in lieu of water. U.S. Pat. No. 4,076,603 supra, discloses the use of perfluorosulfonic acid and perfluoro carboxylic acid polymers to prepare sodium hydroxide. Other art also teaches a general decrease in current efficiency with an increase in sodium hydroxide in the catholyte.

The selective ion-passing effects of cationic membranes such as the perfluorosulfonic acid and perfluorocarboxylic acid type membranes, and the need to optimize the membrane characteristics, ampere density, brine composition, and other design variables, has been noted in the past. Up to this time, the prior art has failed to recognize the distinct advantages of employing particular permselective membranes for particular concentrations of sodium hydroxide in different stages in the stagewise preparation of sodium hydroxide. However, there remained a need for reducing the electrolytic cell equipment size, capital investment and most importantly, the process energy requirement for such operations.

OBJECTS

It is a primary object of this invention to provide an improved electrolytic process for preparing aqueous alkali metal hydroxides.

A further object is to provide an improved electrolytic process for preparing sodium hydroxide whereby the capital requirements and energy requirements are minimized.

An additional object is to provide an improved electrolytic process for preparing sodium hydroxide in a membrane cell whereby the power efficiency is maximized.

A still further object is to provide an improved electrolytic process for preparing sodium hydroxide whereby the current efficiency is maximized while preparing high concentration sodium hydroxide.

BRIEF DESCRIPTION OF THE INVENTION

This invention is a process for the preparation of an alkali metal hydroxide from an alkali metal halide in at least two electrolytic cells, wherein each electrolytic cell is physically arranged in series with respect to the flow of catholyte liquor, the series having a first electrolytic cell and a last electrolytic cell, so that for a selected cell in the series, after the first electrolytic cell, catholyte alkali metal hydroxide from the catholyte chamber of a previous electrolytic cell is conveyed to the catholyte chamber of the selected electrolytic cell. The concentration of the alkali metal hydroxide is progressively increased toward a desired final concentration in the last cell through the series of electrolytic cells. Each electrolytic cell has an anolyte chamber containing an anode and a catholyte chamber containing a cathode, separated by a permselective membrane. The invention is characterized by the improvement wherein a different permselective membrane is employed in at least one cell of the series to maximize cell power efficiency corresponding to the concentration of alkali metal hydroxide produced in the catholyte chamber of each cell.

The FIGURE shows a schematic view of a two stage cell system for the preparation of sodium hydroxide.

DETAILED DESCRIPTION OF THE INVENTION

Figure 1:
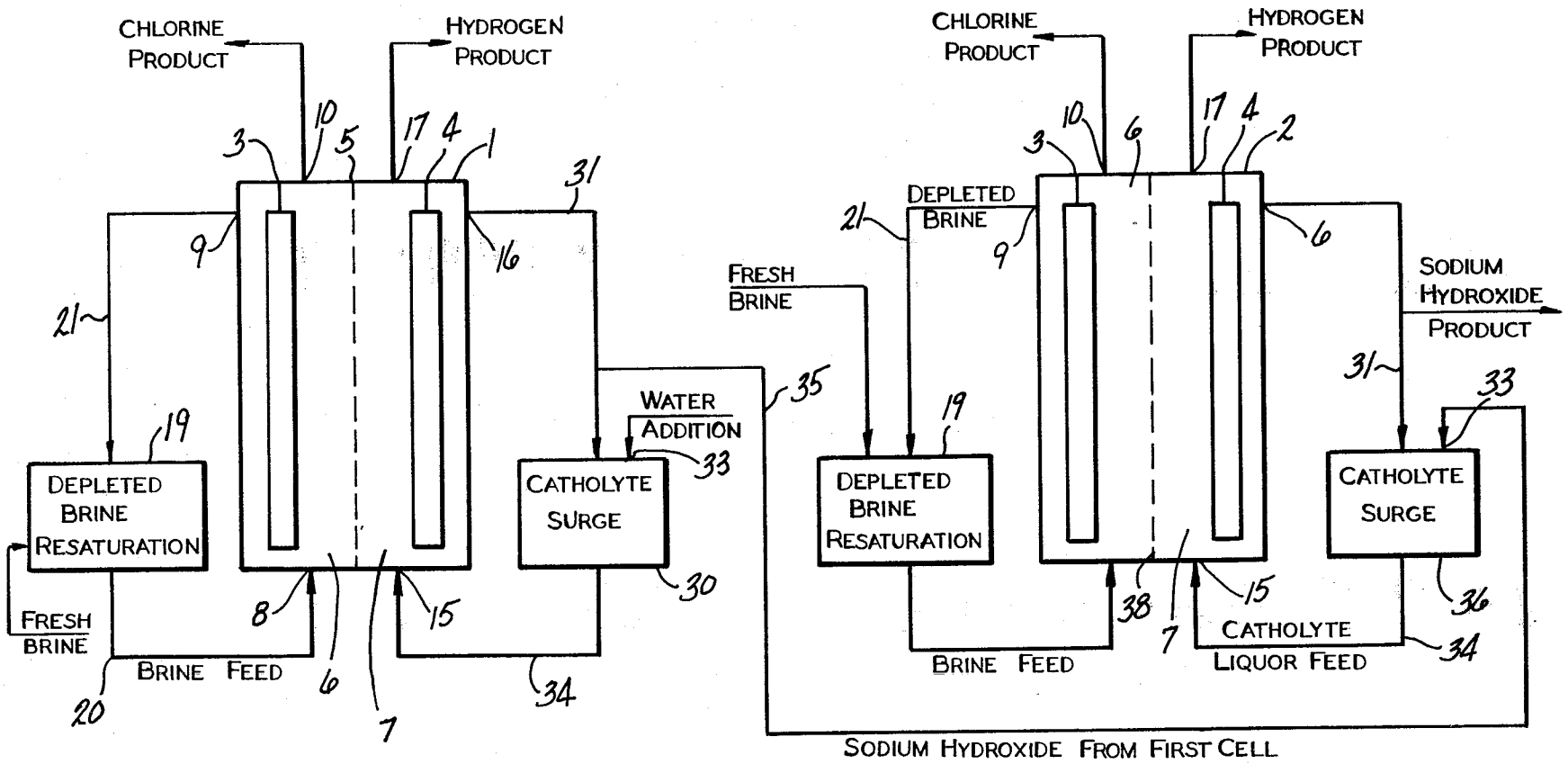

It has now been found that dramatic significant savings in capital investment and energy requirements can be achieved in overcoming the aforementioned problems by using a process for the stagewise production of a halogen and an alkali metal hydroxide, where each cell of a membrane equipped stepwise electrolysis system employs a membrane specifically tailored for the concentration of alkali metal hydroxide concentration produced therein.

Choosing a particular permselective membrane for a particular concentration of sodium hydroxide in the cell catholyte in a series of cell has not been employed in the present processes before and the unexpectedly beneficial results have not been previously obtained or suggested.

The selection of the proper membrane in halogen and alkali metal hydroxide production results in lower power consumption per ton of product in comparison to prior art systems with a simultaneous reduction in capital investment.

The instant invention employs electrolytic cells for the production of alkali metal hydroxide, halogen gases, and hydrogen gas from aqueous solutions of alkali metal halides.

The invention is described with specific reference to the plurality of electrolytic cells employed in the stepwise electrolysis of an aqueous solution of sodium chloride whereby chlorine, sodium hydroxide, and hydrogen are produced. It, however, is not to be construed as limited thereto except as defined in the appended claims.

In accordance with a preferred mode of carrying out the invention, an aqueous solution of sodium chloride is electrolyzed in a plurality of electrolytic cells in series, each cell separated into an anode chamber containing an anode and a cathode chamber containing a cathode using as a separator a permselective membrane.

Located on one side of the permselective membrane, the anode chamber has an outlet for the chlorine gas generated, and an inlet for charging, removing, or circulating anolyte solution.

In the anode chamber, electrolytic decomposition of aqueous sodium chloride brine, occurs according to equation (1) below:

$$2NaCl \xrightarrow{-2e^-} Cl_2 + 2Na^+ \quad (1)$$

The cathode chamber is located on the opposite side of the permselective membrane.

In the cathode chamber, electrolysis of water supplied to the electrolytic cell takes place in accordance wth equation (2) below:

$$2H_2O \xrightarrow{+2e^-} 2OH^- + H_2 \quad (2)$$

The sodium ions from the anode chamber migrate through the membrane to the cathode chamber, and combine with the hydroxyl ions generated in the cathode chamber resulting in the formation of an aqueous sodium hydroxide solution as shown in equation (3):

$$2Na^+ + 2OH^- \rightarrow 2NaOH \quad (3)$$

The cathode chamber has inlets and outlets for the sodium hydroxide solution and/or water and an outlet for hydrogen liberated at the cathode by the electrolysis of water.

The housing or outer casing member and cover of the electrolytic cell is formed of any electrolytically nonconductive or conductive material which is resistant to chlorine, hydrochloric acid and caustic alkali and which will withstand the temperatures at which the cell may be operated. These temperatures are preferably from about 65° to 100° C.

Exemplary of the nonconductive materials which may be used are high temperature polyvinyl chloride, hard rubber, chlorendic acid based polyester resins, and the like. Such materials of construction for this housing member preferably have sufficient rigidity as to be self-supporting.

However, the nonconductive housing may be formed of cement, or concrete lined with materials such as mastics, neoprene, polyvinylidene chloride, fluorinated ethylene propylene (FEP), chlorendic acid based polyester resins, polypropylene, polyvinyl chloride, tetrafluoroethylene, or other suitable plastics.

Conductive materials which may be employed as material of construction include 304 stainless steel, 316 stainless steel, nickel, titanium, and mixtures thereof.

Even in the case of other materials which are substantially self-supporting, such as rigid polyvinyl chloride, polypropylene, phenol formaldehyde resins, it is desirable to provide reinforcing members around the exterior of the housing member to provide additional rigidity.

The term "permselective membrane" refers to a fluid impermeable, ion permeable membrane having a higher cation transport number through the membrane itself than through the solutions adjacent thereto.

A variety of permselective materials may be employed in the process of this invention. Materials suitable for use as permselective membranes in this invention include the sulfonic acid substituted perfluorocarbon polymers of the type described in U.S. Pat. No. 4,036,714, which issued on July 19, 1977 to Robert Spitzer; the primary amine substituted polymers described in U.S. Pat. No. 4,085,071, which issued on Apr. 8, 1978 to Paul Raphael Resnick et al; the polyamine substituted polymers of the type described in U.S. Pat. No. 4,030,988, which issued on June 21, 1977 to Walther Gustav Grot; and the carboxylic acid substituted polymers described in U.S. Pat. No. 4,065,366, which issued on Dec. 27, 1977 to Yoshio Oda et al. All of the teachings of these patents are incorporated herein in their entirety by reference.

With respect to the sulfonic acid substituted polymers of U.S. Pat. No. 4,036,714, these membranes are preferably prepared by copolymerizing a vinyl ether having the formula $FSO_2CF_2CF_2OCF(CF_3)CF_2OCF{=}CF_2$ and tetrafluoroethylene followed by converting the $-SO_2F$ group to either $-SO_3H$ or sulfonate (for example, alkali metal sulfonates) or both. The equivalent weight of the copolymers is in the range from about 900 to about 1600 where equivalent weight is defined as the average molecular weight per sulfonyl group. The preferred weight of the copolymers is in the range from about 950 to about 1350.

Examples of sulfonic acid substituted type membranes include membranes marketed commercially under the trademark NAFION®, manufactured and sold by the duPont Company. Typical membranes include the NAFION® 200 series, NAFION® 204, 214, 255, 295, the NAFION® 300 series, NAFION® 313, 315, 316, 324, 336, 337, 355, 376, 390, 391, and the NAFION® 400 series including NAFION® 427 membrane, mixtures thereof and the like.

With reference to the primary amine substituted polymers of U.S. Pat. No. 4,085,071, the basic sulfonyl fluoride polymer of the U.S. Pat. No. 4,036,714 patent above is first prepared and then reacted with a suitable primary amine wherein the pendant sulfonyl fluoride groups react to form N-monosubstituted sulfonamide groups or salts thereof. In preparing the polymer precursor, the preferred copolymers utilized in the film are fluoropolymers of polyfluorocarbons although others can be utilized as long as there is a fluorine atom attached to the carbon atom which is attached to the sulfonyl group of the polymer. A preferred copolymer is a copolymer of tetrafluoroethylene and perfluoro(3,6-dioxa-4-methyl-7-octenesulfonyl fluoride) which comprises 10 to 60 percent, preferably 25 to 60 percent by weight of the latter. The sulfonyl groups are then converted to N-monosubstituted sulfonamido groups or salts thereof through the reaction of a primary amine.

Polymers similar to the aboe U.S. Pat. No. 4,085,071 are prepared as described in U.S. Pat. No. 4,030,988, wherein the backbone sulfonated fluoride polymers are reacted with a di- or polyamine, with heat treatment of the converted polymer to form diamino and polyamino substituents on the sulfonyl fluoride sites of the copolymer.

The carboxylic acid substituted polymers of U.S. Pat. No. 4,065,366 are prepared by reacting a fluorinated olefin with a comonomer having a carboxylic acid group of a functional group which can be converted to a carboxylic acid group. It is preferred to use a fluorinated copolymer having a molecular weight to give the volumetric melt flow rate of about 100 millimeters per second at a temperature of about 250° to about 300° C. Preferably, the membrane is compared by copolymerizing tetrafluoroethylene with $CF_2{=}CF_2(CF_2)_3COOCH_3$.

Other permselective membranes which may be employed include the acrylic acid styrene copolymer crosslinked with divinyl benzene as disclosed in U.S. Pat. No. 3,933,603, issued to Yoshio Ishida, Hiroshi Ono and Reiji Takemura on Jan. 20, 1976. The teachings of that patent are incorporated herein in its entirety by reference.

Other permselective membranes which may be employed in the process of this invention include copolymers of divinyl benzene and an olefinic carboxylic compound possess ion-exchange characteristics and can be formed into cation permselective membranes as disclosed in U.S. Pat. No. 2,731,408, issued Jan. 17, 1956 to John Thatcher Clarke. Carboxylic membranes, per se, are prepared by copolymerizing divinyl benzene and an olefinic carboxylic compound such as an anhydride, ester or acid chloride or acrylic acid and its derivatives in solution in a suitable solvent. The polymerized solid material is saturated with water or an aqueous solution of an acid or base to convert anhydride, ester or acid groupings in the polymeric matrix to salt or acid forms of carboxylate groups (—CO—or—COOH). The polymerized solids are most useful where the solvent of polymerization in the polymerized solid is replaced by water. The presence of an aqueous solvent phase in the polymerized solid provides a solid structure which is electrically conductive and selectively permeable to cations.

Still other permselective membranes which may be employed in the proces of this invention include the sulfostyrenated FEP membranes in which a standard fluorinated ethylene propylene membrane is styrenated and the styrenated polymer is then sulfonated as disclosed in U.S. Pat. No. 3,954,579 and U.S. Pat. No. 3,899,403, issued to Edward Cook, Jr. and Alvin T. Emery on May 4, 1976 and Aug. 12, 1975 respectively. The teachings of both patents are incorporated by reference.

Although the aforesaid membranes appear to provide the highest overall efficiency in the operation of the process of this invention, any inert hydrophilic membrane material, e.g., exhibiting a high affinity for water that is capable of maximizing the current efficiency in the electrolytic production of alkali hydroxide from a brine containing an alkali halide may be employed in the process of this invention.

Several embodiments of the membranes previously discussed may be employed in the process of this invention.

In a first embodiment, a single perfluorosulfonic acid membrane is prepared by laminating two perfluorosulfonic acid films of different equivalent weight. For example, about a four mils thickness of a sulfonic acid substituted perfluorocarbon polymer having an equivalent weight of about 1100 is laminated to a sulfonic acid substituted perfluorocarbon polymers film of about one mil thickness of about 1500 equivalent weight to form a single permselective membrane. A typical example of this embodiment is a perfluorosulfonic acid membrane, Nafion® 391—manufactured and sold by the duPont Company.

The single permselective membrane is positioned within the electrolytic cell so that the thin, high equivalent weight layer generally faces the cathode, and the thicker, lower equivalent weight layer generally faces the anode.

In a second embodiment, the membrane is prepared from a single unmodified film. For example, a single unmodified perfluorosulfonic acid film of about seven mils thickness and having an equivalent weight in the range from about 1190 to about 1210 may be employed in the process of this invention.

A typical example of this embodiment is a Nafion® 427 perfluorosulfonic acid membrane manufactured and sold by the duPont Company.

The thickness of the membrane is in the range from about 3 to about 20 mils, and preferably from about 5 to about 10 mils. For selected membranes, a laminated inert cloth supporting material for the membrane of polytetrafluoroethylene may be used. When mounted on a polytetrafluoroethylene, asbestos, titanium or other suitable network, for support, the network support filaments or fibers will usually have a thickness in the range from about 0.01 to about 0.5 millimeter, preferably in the range from about 0.05 to about 0.15 millimeter, corresponding to up to the thickness of the membrane. Often it will be preferable for the fibers to be less than half the film thickness but filament thicknesses greater than that of the film may also be successfully employed, e.g., about 1.1 to 5.0 times the film thickness. The networks, screens or cloths have an area percentage of openings therein in the range from about 8 to 80%, preferably 10 to 70% and most preferably 30 to 70%. Generally, the cross sections of the filaments will be circular but other shapes, such as ellipses, squares and rectangles, are also useful. The supporting network is preferably a screen or cloth and although it may be cemented to the membrane, it is preferred that it be fused to it by high temperature, high pressure compression before hydrolysis of the copolymer. Then, the membrane-network composite can be clamped or otherwise fastened in place in a holder or support.

Within the membrane cell, at least one electrode is positioned within the anolyte chamber and one electrode within the catholyte chamber. For maximum exposure of the electrolytic surface, the face of the electrode should be parallel to the plane of the membrane.

The electrodes for the present electrolytic cell may be formed of any electrically conductive material which will resist the corrosive attack of the various cell reactants and products with which they may come in contact, such as alkali metal hydroxides, hydrochloric acid, and chlorine.

Typically, the cathode is constructed of iron, nickel and their alloys, or the like, with steel being generally preferred unless strong hydrochloric acid solution is being electrolyzed. Any cathode material that is capable of effecting the electrolytic reduction of water may be employed as cathode construction material in the process of this invention. Those materials having a low hydrogen overvoltage are preferred.

Similarly, the anodes may be formed of graphite or may be metallic anodes. Typically, where metallic anodes are used, these may be formed of a so-called "valve" metal, such as titanium, tantalum or niobium as well as alloys of these in which the valve metal constitutes at least about 90% of the alloy. The surface of the valve metal is made active by means of a coating of one or more noble metals, noble metal oxides, or mixtures of such oxides, either alone or with oxides of the "valve" metal. The noble metals which may be used include ruthenium, rhodium, palladium, iridium, and platinum. Preferred metal anodes are those formed of titanium and having a mixed titanium oxide and ruthenium oxide coating on the surface, as is described in U.S. Pat. No. 3,632,498, issued to H. B. Beers on Jan. 4, 1972.

Additionally, the valve metal substrate may be clad on a more electrically conductive metal core, such as aluminum, steel, copper, or the like.

When such electrodes are employed as anodes, anodic chlorine overvoltage is minimized. Any electrode construction capable of effecting electrolytic production of alkali hydroxide from a brine containing an alkali halide may be employed in the process of this invention.

The cathode and anode may each be of either solid, felt, mesh, foraminous, packed bed, expanded metal or other design.

The distance between an electrode, such as the anode or the cathode, to the separator for example a permselective membrane, is known as the gap distance for that electrode. The gap distance of the anode to membrane and the cathode to membrane are independently variable. Changing these respective distances concurrently or individually may affect the operational characteristics of the electrolytic cell and is reflected in the measured voltage.

For the process of this invention for each cell, the cell current efficiency is defined as the ratio of the number of chemical equivalents of chlorine formed divided by the electrical equivalents consumed in forming that product×100. This may be expressed mathematically by the following equation (1):

$$(1)\%\ \text{Current Efficiency} = (A/B/C/D) \times 100$$

where

A = Mass of product produced in grams.

B = Equivalent weight of product produced in grams per equivalent.

C = Quantity of electricity consumed in making desired product in ampere hours.

D = Faraday's Constant of 26.81 ampere hours per equivalent.

The power efficiency may be expressed mathematically by the following equations (2), (3), and (4):

$$\text{Voltage Efficiency} = \frac{\text{decomposition voltage}\left(\begin{array}{c}\text{about 2.3 volts}\\ \text{for NaCl}\end{array}\right)}{\text{cell voltage}} \quad (2)$$

$$\%\ \text{Power Efficiency} = \%\ \text{Current Efficiency} \times \text{Voltage Efficiency} \quad (3)$$

$$\text{Power Efficiency} = \frac{686 \times \text{Decomposition Voltage}}{\text{Power Consumption per ton of } Cl_2} \quad (4)$$

In general, preferable anode to membrane and preferable cathode to membrane gap distances can be defined for any alkali hydroxide and brine composition used as the anolyte in the membrane electrolytic cell. When using sodium hydroxide and sodium chloride brine solution as the anolyte, the preferable anode to membrane gap distance is in the range from about 1/64 to about ¼ inch, and the preferable cathode to membrane gap distance is in the range from about 1/64 to about ¼ inch.

Essentially, the same distances are also useful for other alkali hydroxides and other alkali metal halide brines.

The term "alkali metal halide" as employed throughout the claims and descriptions includes lithium chloride, sodium chloride, potassium chloride, rubidium chloride, cesium chloride, lithium bromide, sodium bromide, potassium bromide, rubudium bromide, cesium bromide, lithium iodide, sodium iodide, potassium iodide, rubidium iodide, cesium iodide, and mixtures thereof.

The alkali metal halide is generally contained in an aqueous solution.

For example, when employing sodium chloride, the brine concentration will be as high as feasible and is in the range from about 175 to about 350 grams per liter and preferably is in the range from about 250 to about 327 grams per liter. The concentration of potassium chloride in a brine charged is as high as feasible normally in the range from about 200 to about 360 grams per liter with an intermediate concentration for mixtures of sodium chloride and potassium chloride.

The particular water soluble alkali metal halide employed will depend upon the alkali hydroxide which it is desired to be prepared. Thus, for example, when it is desired to prepare sodium hydroxide, then sodium halide brine is employed.

The alkali metal halide solution employed for the production of caustic and chlorine can be obtained from any suitable source, for example, by using naturally occurring sodium chloride. In any event, to assure optimum operation conditions, and high operating efficiency, the salt solution should be of high purity.

In general, the process of the present invention, whether using a brine may be operated over a wide temperature range, e.g., from about 20° C. up to the boiling point of the anolyte or catholyte. Temperatures in the range from about 65° to about 100° C. are preferred.

The operating pressure of the cell is essentially atmospheric but may be sub- or superatmospheric, if desired.

In the process of this invention for the preparation of sodium hydroxide from sodium chloride brine in a plurality of electrolytic cells, each electrolytic cell is physically arranged in series with respect to the other electrolytic cells, said series having a first electrolytic cell and a last electrolytic cell, so that for a selected cell after the first of the electrolytic cells, the catholyte sodium hydroxide from the catholyte chamber of a previous electrolytic cell is conveyed to the catholyte chamber of the selected electrolytic cell. The concentration of the sodium hydroxide is progressively increased toward a desired final concentration in the last cell through the series of electrolytic cells. Each electrolytic cell has an anolyte chamber containing an anode and a catholyte chamber containing a cathode, separated by a selected permselective membrane previously described employed to maximize cell current efficiency or cell power efficiency corresponding to the concentration of the sodium hydroxide produced in the catholyte chamber of that cell.

Although the same permselective membrane may be employed in each of the electrolytic cells of the process of this invention far superior results are obtained when different permselective membranes of Group A and Group B defined below are employed in the electrolytic cells.

The term "relatively low concentration" is employed throughout the claims and description to include aqueous solutions of sodium hydroxide having a concentration in the range from about 10 to about 22 percent sodium hydroxide by weight.

Relatively low concentration may be produced in a first electrolytic cell by the process of this invention.

The term "relatively high concentration" is employed throughout the claims and description to include aqueous solutions of sodium hydroxide having a concentration in the range from about 27 to about 50 percent sodium hydroxide by weight.

Relatively high concentration sodium hydroxide may be produced in the last electrolytic cell by the process of this invention.

In a first embodiment, a permselective membrane of Group A is preferably employed in a first cell producing relatively low concentration sodium hydroxide which includes a single perfluorosulfonic acid membrane prepared by laminating two perfluorosulfonic acid films of different equivalent weight. For example, about a four mils thickness of a sulfonic acid substituted perfluorocarbon polymer having an equivalent weight of about 1100 is laminated to a sulfonic acid substituted perfluorocarbon polymer film of about one mil thickness of about 1500 equivalent weight to form a single permselective membrane known in the trade as NAFION® 391 membrane.

Another example of a permselective membrane in Group A which may be employed in a first cell producing relatively low concentration sodium hydroxide includes a single perfluorosulfonic acid membrane prepared by laminating two perfluorosulfonic acid films of different equivalent weight. For example, about a four mil thickness of a sulfonic acid substituted perfluorocarbon polymer having an equivalent weight of about 1100 is laminated to a sulfonic acid substituted perfluorocarbon polymer film of about one and one half mil thickness to form a single permselective membrane known in the trade as NAFION® 390 membrane.

In a last cell in the series, a permselective membrane of Group B is employed to produce relatively high concentration sodium hydroxide which includes a membrane prepared from a single modified film. For example, a member of Group B is a single modified perfluorosulfonic acid film of about seven mils thickness and having an equivalent weight in the range from about 1190 to about 1210 and having an ethylene diamine treated layer as disclosed in U.S. Pat. No. 4,085,071, supra, of about one and one half mil thickness, and known in the trade as NAFION® 227.

In a last cell therewith, another example of a permselective membrane in Group B is employed to produce relatively high concentration sodium hydroxide includes a membrane prepared from a single unmodified film. For example, a single unmodified perfluorosulfonic acid film of about seven mils thickness and having an equivalent weight in the range from about 1190 to about 1210 may be employed in the process of this invention and is known in the trade as NAFION® 427 membrane.

Various combinations of electrolytic cells may be employed in the process of this invention. For example, a plurality of electrolytic cells may be employed as stage one in the process and a single or plurality of cells may be employed as subsequent stages in the process of this invention.

For purposes of simplicity, the invention is described in terms of a two-cell series stepwise arrangement. It is recognized that the number of cells previously described and employed in the series arrangement may be as many as desired.

The process of this invention is described with reference to the FIGURE, which shows a two-cell system for the preparation of sodium hydroxide in a schematic view. Electrolytic cell 1 and electrolytic cell 2 are arranged in series fashion and are of the type previously described.

Electrolytic cell 1 is a vessel comprised of an anode 3, a cathode 4, separated by an appropriately chosen previously described permselective membrane 5 to form an anode chamber 6 and a cathode chamber 7.

Electrolytic cell 1 has a process inlet 8 in the anode chamber 6 for the anolyte and fresh sodium chloride brine feed, an outlet 9 for depleted sodium chloride brine and an outlet 10 for chlorine gas.

There is also an inlet 15 for charging water and liquid such as aqueous sodium hydroxide to the cathode chamber 7, an outlet 16 for discharging catholyte sodium hydroxide from cathode chamber 7 and an outlet 17 for discharging hydrogen gas.

Fresh sodium chloride brine is charged to the depleted brine resaturation vessel 19, where it is mixed with depleted brine and the resulting strong brine is conveyed to anode chamber 6 by process line 20 through process inlet 8. Depleted brine is discharged from anode chamber 6 at outlet 9 and transferred to depleted brine resaturation vessel 19 by process connection 21.

Catholyte sodium hydroxide is discharged from cathode chamber 7 through outlet 16 and transferred to catholyte surge 30 by process connection 31. Water or other liquid may be added to catholyte surge 30 by process connection 33.

A portion of the catholyte sodium hydroxide may be returned to cathode chamber 7 from catholyte surge 30 by process connection 34 to inlet 15.

Process line 35 is employed to transfer catholyte sodium hydroxide from electrolytic cell 1 to the catholyte surge 36 of electrolytic cell 2, then through the catholyte surge 36 to the cathode chamber 7 of electrolytic cell 2 by process connection 34.

Electrolytic cell 2 generally corresponds to electrolytic cell 1. However, permselective membrane 38 of electrolytic cell 2 is a different material than permselective membrane 5 of electrolytic cell 1 and each membrane being selected to maximize the cell current efficiency or cell power efficiency.

Sodium hydroxide product is discharged from electrolytic cell 2 at outlet 16 from cathode chamber 7. A portion of the sodium hydroxide product may be recycled to cathode chamber 7 through catholyte surge 36.

In operation of the two-cell series stepwise arrangement, sodium chloride brine containing in the range from about 200 to about 350 grams per liter sodium chloride is fed to the anode chamber 6 of electrolytic cell 1 and electrolytic cell 2.

The concentration of sodium chloride brine in the anode chamber 6 in both electrolytic cells is in the range from about 200 to about 300 grams per liter.

The rate at which the brine solution is charged to the anode chamber 6 and the rate at which the depleted solution is removed is usually controlled in a manner as to obtain a brine utilization in the range from about 10 to about 50% of the sodium chloride present in the brine originally charged to the electrolytic cells.

In operation of the process of this invention, direct current is supplied to the electrolytic cell and a voltage is impressed across the cell terminals.

For example, the concentration of sodium hydroxide in cathode chamber 7 of electrolytic cell 1 is in the range from about 100 to about 350 grams per liter.

The concentration of the sodium hydroxide is maintained by withdrawing catholyte containing a quantity of sodium hydroxide equivalent to the production of the cell. Additional water is added to catholyte surge 30 to satisfy the water requirements of electrolytic cell 1.

The sodium hydroxide of electrolytic cell 1 is transferred to the cathode chamber 7 of electrolytic cell 2. Water may also be added to cathode chamber 7 is desired.

The concentration of sodium hydroxide in the cathode chamber 7 of electrolytic cell 2 is in the range from about 400 to about 500 and preferably in the range from about 420 to about 450 grams sodium hydroxide per liter of solution.

Various methods are employed to optimize the power efficiency of the membrane equipped electrolytic cell. For example, U.S. Pat. No. 4,056,448, issued to Andrew D. Babinsky and Ronald L. Dotson on Nov. 1, 1977, discloses a method for optimizing current efficiencies in membrane chlor-alkali electrolytic cells by constant precise control of both the brine and caustic concentrations at each membrane phase boundary. Such control requires recycling through external holding tanks. The teachings of that patent are incorporated herein in its entirety by reference.

The examples hereafter described represent the results of a series of preparations of aqueous solutions of sodium hydroxide.

The high concentration sodium hydroxide solution made is essentially free of sodium chloride often containing as little as about 0.1 to about 10 grams sodium chloride per liter of solution.

The high concentration sodium hydroxide solution produced may be sold, employed in chemical reactions to prepare sodium chlorate or evaporated to still higher concentrations. For example, only one pound of water must be evaporated per pound of product sodium hydroxide of this invention to produce about 50 weight percent sodium hydroxide for sale.

Chlorine may be reacted with the sodium hydroxide to form sodium hypochlorite or sodium chlorate. Otherwise, the chlorine is salable, usually after liquefaction, in which case any oxygen present is removed.

Hydrogen is sold, employed as a fuel, or otherwise utilized.

The following examples are presented to define the invention more fully without any intention of being limited thereby. All parts and percentages are by weight unless indicated otherwise.

EXAMPLE 1

In this example, two electrolytic cells employing different permselective membranes were employed to prepare high concentration sodium hydroxide. The two electrolytic cells had polytetrafluoroethylene housings and were physically positioned in a series arrangement whereby the sodium hydroxide prepared in the catholyte chamber of the first cell was conveyed to the catholyte chamber of the second cell in lieu of adding water to the second cell. Each cell employed a different sulfonic acid substituted perfluorocarbon polymer.

In the first cell, a perfluorocarbon membrane known in the trade as NAFION® 391 membrane and manufactured and sold by the duPont Company was employed. The membrane was comprised of about a four mil thickness of a sulfonic acid substituted perfluorocarbon polymer having an equivalent weight of about 1100 laminated to a sulfonic acid substituted perfluorocarbon polymer film of about one mil thickness of about 1500 equivalent weight to form a single permselective membrane.

In the second cell, a perfluorocarbon membrane known in the trade as NAFION® 427 membrane and manufactured and sold by the duPont Company was employed. The membrane was comprised of a single unmodified perfluorosulfonic acid film of about seven mils thickness and having an equivalent weight of about 1200.

For both cells, a saturated sodium chloride salt solution containing about 320 grams sodium chloride per liter was fed to the anode chamber of each cell. The anolyte was removed from the anode chamber of each cell at a concentration of about 284 grams sodium chloride per liter of solution.

The operating temperature of each cell was in the range from about 80° to about 85° C. The operating pressure of each cell was about atmospheric. Water was added to the catholyte chamber of the first cell only.

Material of construction employed as anodes in both cells was a ruthenium oxide containing catalytic-surfaced anode.

For both cells, the anode to permselective membrane gap distance and the cathode to permselective membrane gap distance was about 0.30 centimeter.

During operation of the first cell, water was fed to the cathode chamber and a direct current passed through the cell at a current density of about two kiloamperes per square meter. The first cell operated at about 3.2 volts and had a calculated current efficiency of about 87.9%.

The concentration of sodium hydroxide prepared in the cathode chamber of the first cell was about 220 grams sodium hydroxide per liter of solution.

Since theoretically, about 686 kiloamperes of current is required for the production of about one ton of chlorine, the power consumption of the electrolytic cell producing sodium hydroxide was calculated for each example as follows:

$$\text{Power Consumption per Ton of Chlorine} = \frac{686 \text{ Kiloamperes} \times \text{Cell Voltage (Volts)}}{\text{Cell Current Efficiency}}$$

The power consumption for the first cell was calculated to be about 2447 kilowatt hours per ton chlorine produced.

The second cell operated at a current density of about two kiloamperes per square meter, about 3.8 volts, and a current efficiency of about 71.7%. The power consumption for the second cell was calculated to be about 3635 kilowatt hours per ton chlorine.

The concentration of sodium hydroxide prepared in the cathode chamber of the second electrolytic cell was about 440 grams sodium hydroxide per liter of solution.

The overall power consumption is the sum of the power supplied to each electrolytic cell divided by the total product made. The total overall power consumption in the two stages was calculated to be 2981 kilowatt hours per ton of total chlorine produced. Only one pound of water must be evaporated per pound of product sodium hydroxide of the second cell to produce 50 weight percent sodium hydroxide for sale.

Chlorine gas was produced in the catholyte chambers of both the first and second cells.

Hydrogen gas was produced in the anolyte chambers of both the first and second cells.

Example 1 illustrates reduction of power consumption for the stagewise preparation of sodium hydroxide when the permselective membrane of the first cell was different from the permselective membrane of the second cell.

COMPARATIVE EXAMPLE A

Conditions were the same in Comparative Example A as in Example 1, except that the same sulfonic acid substituted perfluorocarbon membrane NAFION® 427 membrane, previously described in Example 1, was employed in both the first and second stage cells.

The first cell was operated at a current density of about two kiloamperes per square meter, a voltage of about 3.2 volts, and a current efficiency of about 61%. The power consumption for the first cell was calculated to be about 3643 kilowatt hours per ton chlorine.

The second cell was operated at a current density of about two kiloamperes per square meter, a voltage of about 3.4 volts, and a current efficiency of about 71%. The power consumption was calculated to be about 3272 kilowatt hours per ton chlorine.

The overall total power consumption was calculated to be about 3443 kilowatt hours per ton of total chlorine produced.

COMPARATIVE EXAMPLE B

Conditions were the same in this example as in Comparative Example A, except that the sulfonic acid substituted perfluorocarbon membrane employed in both the first and second cells was NAFION® 391 membrane previously described in Example 1.

The first stage operated at a current density of about two kiloamperes per square meter, a voltage of about 3.3 volts, and had a calculated current efficiency of about 82.5%. The power consumption of the first stage was calculated to be about 2777 kilowatt hours per ton chlorine.

The second stage operated at a current density of about two kiloamperes per square meter, a voltage of about 3.7 volts, and had a calculated current efficiency of about 64%. The power consumption for the second stage was calculated to be about 3923 kilowatt hours per ton chlorine produced.

The overall total power consumption was calculated to be about 3277 kilowatt hours per ton chlorine produced.

COMPARATIVE EXAMPLE C

Conditions were the same in this example as in Comparative Example B.

The first stage operated at a current density of about two kiloamperes per square meter, a voltage of about 3.2 volts, and had a calculated current efficiency of about 89.7%. The power consumption for the first stage was calculated to be about 2447 kilowatt hours per ton chlorine produced.

The second stage operated at a current density of about two kiloamperes per square meter, a voltage of about four volts, and had a calculated current efficiency of about 71%. The power consumption for the second stage was calculated to be about 3845 kilowatt hours per ton chlorine produced.

The overall total power consumption was calculated to be about 3065 kilowatt hours per ton chlorine produced.

COMPARATIVE EXAMPLE D

Conditions were the same in this example as in Example 1, except that only a single electrolytic cell was employed to prepare high concentration sodium hydroxide having about 440 grams sodium hydroxide per liter of solution.

The single cell employed was a NAFION® 391 sulfonic acid substituted perfluorocarbon member.

The cell operated at a current density of about two kiloamperes per square meter, a voltage of about four volts, and had a calculated current efficiency of about 71%.

The power consumption was calculated to be about 3845 kilowatt hours per ton chlorine produced.

COMPARATIVE EXAMPLE E

Conditions were the same in this comparative example as in Comparative Example D, except that the single electrolytic cell employed a NAFION® 427 sulfonic acid substituted perfluorocarbon membrane.

The cell operated at a current density of about two kiloamperes per square meter, a voltage of about 3.4 volts, and had a calculated current efficiency of about 64%.

The power consumption was calculated to be about 3682 kilowatt hours per ton chlorine produced.

COMPARATIVE EXAMPLE F

Conditions were the same in this comparative example as in Comparative Example D, except that relatively low concentration sodium hydroxide having about 109 grams sodium hydroxide per liter of solution was prepared.

The single cell employed a NAFION® 391 sulfonic acid substituted perfluorocarbon membrane.

The cell operated at a current density of about two kiloamperes per square meter, a voltage of about 3.1 volts, and had a calculated current efficiency of about 89%.

The power consumption was calculated to be about 2383 kilowatt hours per ton chlorine produced.

COMPARATIVE EXAMPLE G

Conditions were the same as in Comparative Example E, except that relatively low concentration sodium hydroxide having about 109 grams sodium hydroxide per liter of solution was prepared.

The single cell employed a NAFION® 427 sulfonic acid substituted perfluorocarbon membrane.

The cell operated at a current density of about two kiloamperes per square meter, a voltage of about 3.4 volts, and had a calculated current efficiency of about 80%.

The power consumption was calculated to be about 2932 kilowatt hours per ton chlorine produced.

What is claimed is:

1. A process for the preparation of an alkali metal hydroxide from an alkali metal halide in at least two electrolytic cells having a first electrolytic cell and a last electrolytic cell physically arranged in series with respect to the flow of alkali metal hydroxide whereby the concentration of alkali metal hydroxide in said first cell is progressively increased toward a desired final concentration in said last cell, and employing in each electrolytic cell a permselective membrane, said permselective membrane employed in said last electrolytic cell corresponds to the concentration of alkali metal hydroxide produced in the catholyte chamber of said last electrolytic cell and being selected from the group consisting of single amine modified perfluorosulfonic acid film and a single unmodified perfluorosulfonic acid film, and said permselective membrane employed in said first electrolytic cell is a membrane different from that employed in said last electrolytic cell and is selected from the group consisting of sulfonic acid substituted perfluorocarbon polymers, primary amine modified perfluorocarbon polymers, di- or polyamine modified perfluorocarbon polymers, single perfluorosulfonic acid membranes prepared by laminating two perfluorosulfonic acid films of different equivalent weight, carboxylic acid substituted polymers, acrylic acid styrene copolymer crosslinked with divinyl benzene polymers, carboxylic acid membranes prepared by copolymerizing divinyl benzene with an anhydride, ester or acid chloride of acrylic acid and its derivatives in a solvent or solution, sulfostyrenated fluorinated ethylene propylene membranes and mixtures thereof.

2. The process of claim 1, wherein said permselective membrane employed in said first electrolytic cell is selected from the group consisting of a single perfluorosulfonic acid membrane prepared by laminating two perfluorosulfonic acid films of different equivalent weight.

3. The process of claim 2, wherein said permselective membrane employed in said last electrolytic cell is selected from the group consisting of amine modified perfluorosulfonic acid films having an equivalent weight in the range from about 1190 to about 1210 and about 7 mils thickness and unmodified perfluorosulfonic acid films having an equivalent weight in the range from about 1190 to about 1210 and about 7 mils thickness.

4. The process of claim 1, wherein said permselective membrane employed in said first electrolytic cell is different from said permselective membrane employed in said last electrolytic cell.

5. The process of claim 4, wherein said permselective membrane employed in said first cell is a single perfluorosulfonic acid membrane prepared by laminating two perfluorosulfonic acid films of different equivalent weight.

6. The process of claim 5, wherein said permselective membrane employed in said last cell is a single perfluorosulfonic acid membrane prepared from a single modified film.

7. The process of claim 6, wherein said permselective membrane employed in said first cell is a membrane comprised of about a four mil thickness of a sulfonic acid substituted perfluorocarbon polymer having an equivalent weight of about 1100 laminated to a sulfonic acid substituted perfluorocarbon polymer film of about one mil thickness of about 1500 equivalent weight to form a single permselective membrane and said permselective membrane employed in said last cell is a single unmodified perfluorosulfonic acid film of about seven mils thickness and having an equivalent weight of about 1200.

8. The process of claim 6, wherein said permselective membrane employed in said first cell is a permselective membrane comprised of about a four mil thickness of a sulfonic acid substituted perfluorocarbon polymer having an equivalent weight of about 1100 laminated to a sulfonic acid substituted perfluorocarbon polymer film of about one and one half mils thickness of about 1500 equivalent weight to form a single permselective membrane and said permselective membrane employed in said last cell is a single modified perfluorosulfonic acid film of about seven mils thickness having an equivalent weight of about 1200 and having an ethylene diamine treated layer of about one and one half mil thickness.

9. The process of claim 1, wherein said alkali metal hydroxide is sodium hydroxide.

10. The process of claim 9, wherein said concentration in said last cell is in the range from about 27 to about 50 percent by weight of sodium hydroxide.

11. The process of claim 9, wherein said concentration in said first cell is in the range from about 10 to about 22 percent by weight of sodium hydroxide.

12. The process of claim 1, wherein said alkali metal halide is sodium chloride.

13. The process of claim 1, wherein said alkali metal halide is potassium chloride.

14. The process of claim 1 in which said cell series is comprised of two cells.

* * * * *